United States Patent [19]

Nelson

[11] 3,990,283

[45] Nov. 9, 1976

[54] REMOVABLE CYLINDER FOR A LOCK

[75] Inventor: Kenneth R. Nelson, West Vancouver, Canada

[73] Assignee: Schlage Lock Company, San Francisco, Calif.

[22] Filed: Oct. 20, 1975

[21] Appl. No.: 623,721

[52] U.S. Cl. ..... 70/308
[51] Int. Cl.[2] ..... E05B 27/00
[58] Field of Search ..... 70/368, 367, 369, 372

[56] References Cited

UNITED STATES PATENTS

| | | | |
|---|---|---|---|
| 2,097,192 | 10/1937 | Jacobi | 70/368 |
| 2,480,026 | 8/1949 | Jacobi | 70/368 |
| 3,776,008 | 12/1973 | Schlage | 70/368 |

*Primary Examiner*—Robert L. Wolfe
*Attorney, Agent, or Firm*—Lothrop & West

[57] ABSTRACT

A removable cylinder for a lock has a shell extending along an axis and holding a pin tumbler unit movable along the axis into and out of the shell, being limited in its movement into the shell by a face plate. A key plug having a keyway in it is mounted in the pin tumbler unit so that the key plug can be rotated about the axis in order to actuate the lock. A stop lever is rotatable about the axis between a first position in axial alignment with an end wall of the shell and a second position clear of the end wall of the shell to hold the pin tumbler unit in the shell and to release it from the shell. There is a rod located between the shell and the pin tumbler unit and extending generally parallel to the axis from a tool access passage in the front of the pin tumbler unit and face plate toward the stop lever. The rod is movable by a tool within the access passage. A clutch lug on the rod in one position is in engagement with the pin tumbler unit and the stop lever and in another position is in engagement with the stop lever and the key plug. A tool inserted through the access passage displaces the rod so that the clutch lug disengages from the pin tumbler unit and engages the plug and the stop lever. Rotation of the key plug by the normal key therein then rotates the stop lever to clear the shell so that the cylinder can be removed. When the cylinder is replaced and the key reversely rotates the plug and stop lever, the stop lever is turned into alignment with the shell, the rod is displaced and the clutch lug is reengaged with the pin tumbler unit.

18 Claims, 22 Drawing Figures

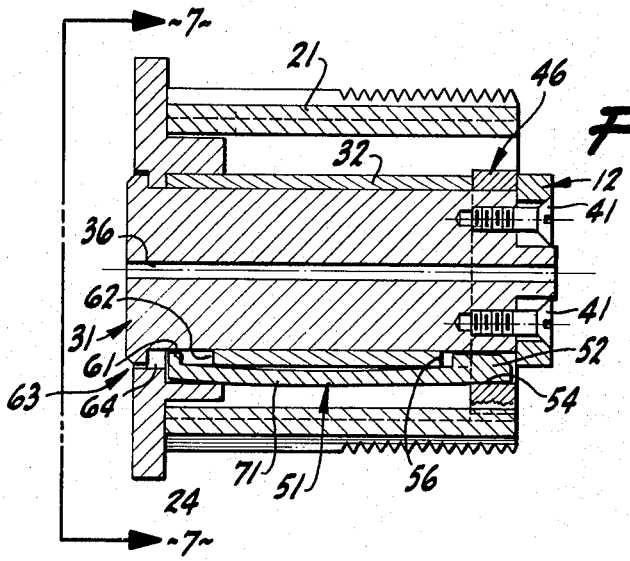
FIG-6
FIG-7
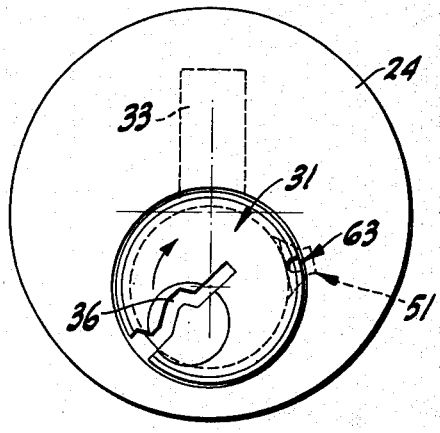
FIG-9
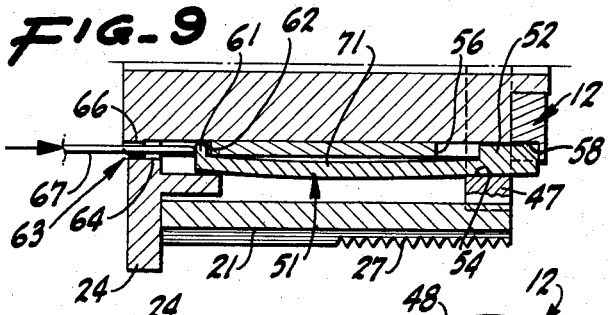
FIG-8
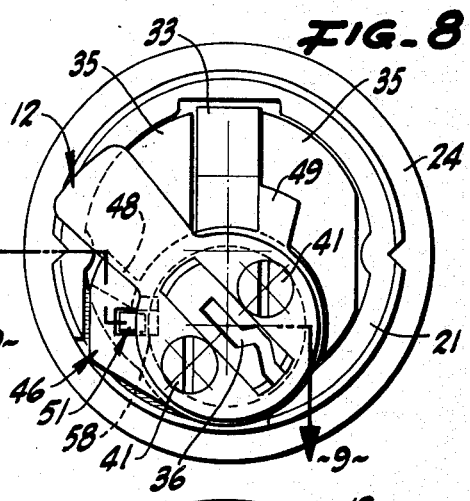
FIG-10
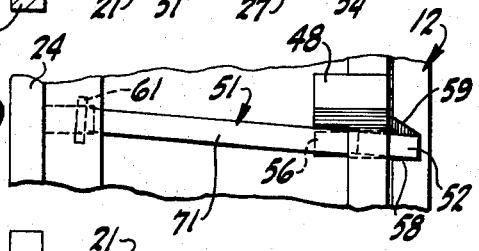
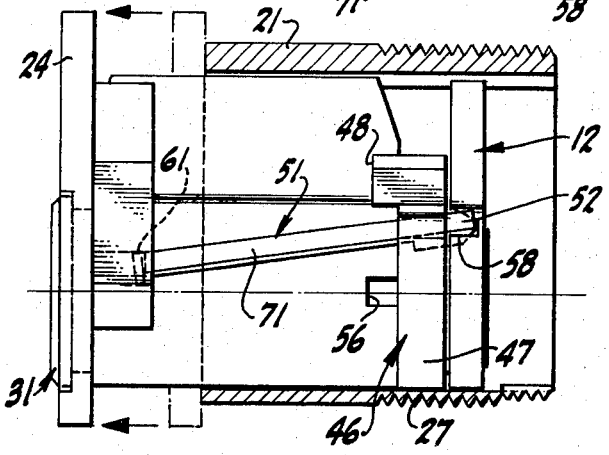
FIG-11
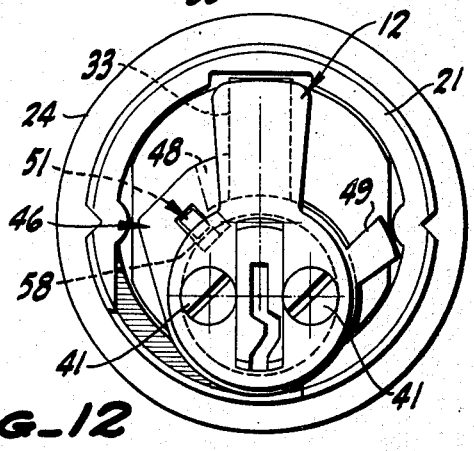
FIG-12

FIG-17
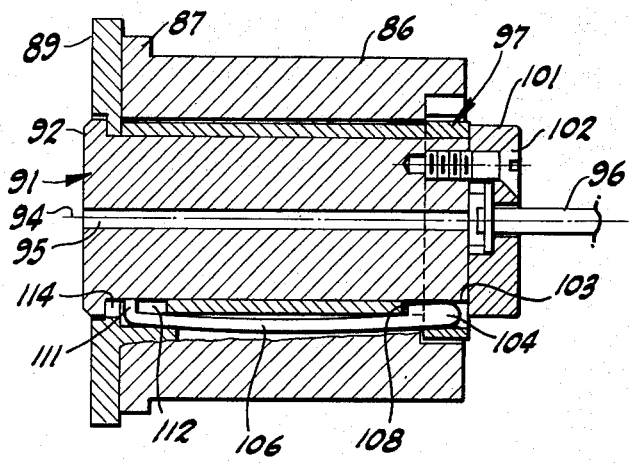
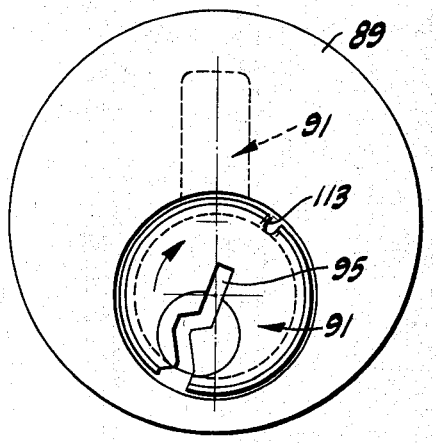
FIG-18
FIG-20
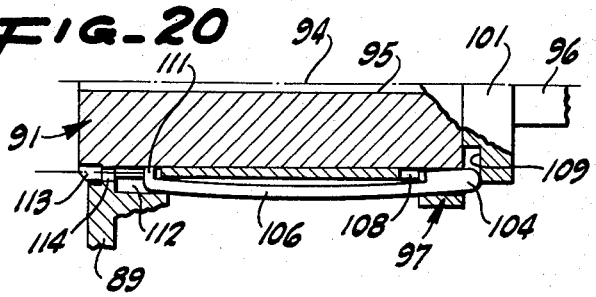
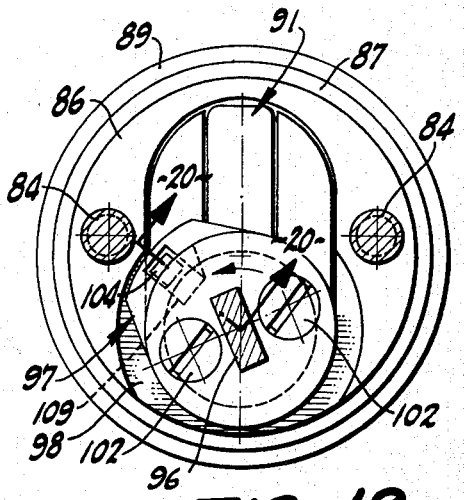
FIG-19
FIG-22
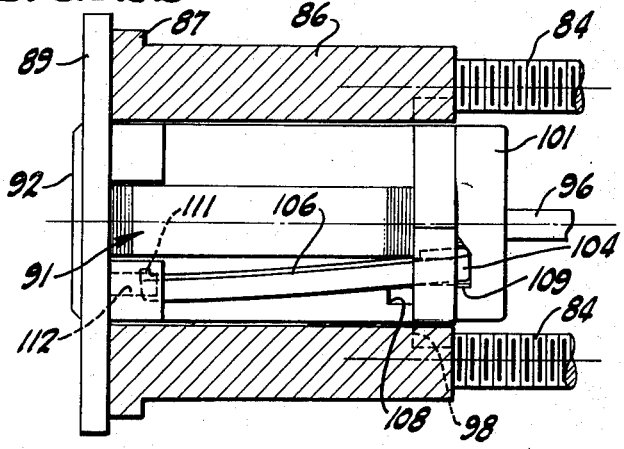
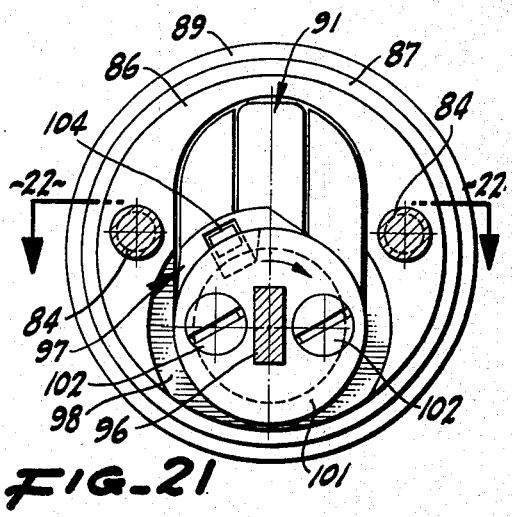
FIG-21

REMOVABLE CYLINDER FOR A LOCK

In various lock installations, particularly installations involving the use of pin tumbler mechanisms, it is often desired to change the combination of the lock without requiring the employment of a locksmith to disassemble the entire lock and to revise the lock pin mechanism in order to afford a new combination and a new key. There are locks available in which two keys are employed, one having the effect of providing the usual lock actuation and the other effective to remove the cylinder from the lock in order that another differently combinated cylinder can be substituted. There are also removable cylinders which do not require a second key but with the regular key employ some sort of specialized tool so that the cylinder can be removed for replacement. While these arrangements are satisfactory and are commercially employed, there is still a demand for a removable cylinder for a lock which can more readily be changed, which involves very little special mechanism or technique and which does not require the simultaneous presence of two instrumentalities for removing the cylinder.

It is therefore an object of the invention to provide an improved removable cylinder for a lock.

Another object of the invention is to provide a removable cylinder for a lock in which the removable cylinder is of substantially standard construction and which involves only a small amount of variation to produce additional advantages.

A further object of the invention is to provide a removable cylinder for a lock which from the exterior and to a casual observer has an appearance very little different from a non-removable cylinder for the same lock.

A further object of the invention is to provide a removable cylinder for a lock which can readily be incorporated in lock mechanisms, most elements of which are already available.

A further object of the invention is to provide a removable cylinder for a lock in which the mechanism having to do with removability does not in any way adversely affect the remaining lock structure.

An additional object of the invention is to provide a removable cylinder for a lock that can be easily serviced and repaired, if necessary.

Other objects, together with the foregoing, are attained in the embodiments of the invention described in the accompanying description and illustrated in the accompanying drawings, in which:

FIG. 6 is a cross-section, the planes of which are indicated by the line 6—6 of FIG. 3;

FIG. 7 is a view comparable to FIG. 2 but with the key plug in a different position;

FIG. 8 is a view comparable to FIG. 5 but with the stop lever and associated parts in a different position;

FIG. 9 is a partial cross-section comparable to FIG. 6, the section being indicated by the line 9—9 of FIG. 8 and showing the rod mechanism in a different position;

FIG. 10 is a view comparable to FIG. 3, with portions broken away, and showing the rod mechanism in a different position;

FIG. 11 is a view comparable to FIG. 3 but with the rod and associated parts in a different position;

FIG. 12 is a view comparable to FIGS. 5 and 8 with the parts in a different position;

FIG. 17 is a cross-section, the planes of which are indicated by the lines 17—17 of FIG. 16;

FIG. 18 is an elevation comparable to FIG. 14 but showing the parts in a different position;

FIG. 19 is a view comparable to FIG. 16 but with the parts shown in a different position;

FIG. 20 is a detailed cross-section, the plane of which is indicated by the line 20—20 of FIG. 19;

FIG. 21 is an end elevation comparable to FIG. 19 but showing the parts in a different position; and FIG. 22 is a cross-section, the plane of which is indicated by the line 22—22 of FIG. 21.

While the removable cylinder for a lock pursuant to this invention can be incorporated in a number of different ways and in connection with a number of different locks, it has with success been incorporated in two different lock installations as shown herein.

Figure 1:
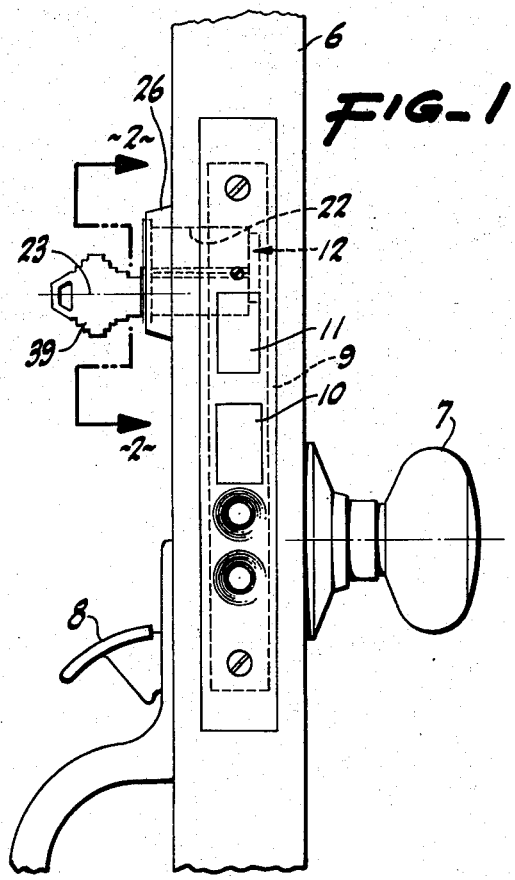
FIG. 1 is an end elevation of a door panel in which there is installed a mortise lock containing a removable cylinder according to the invention, the lock being a typical entrance lock.
Figure 2:
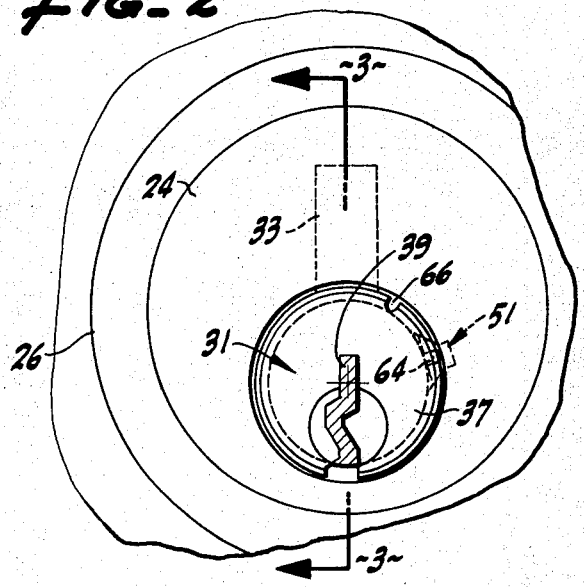
FIG. 2 is a detailed cross-section, the plane of which is indicated by the line 2—2 of FIG. 1.
Figure 4:
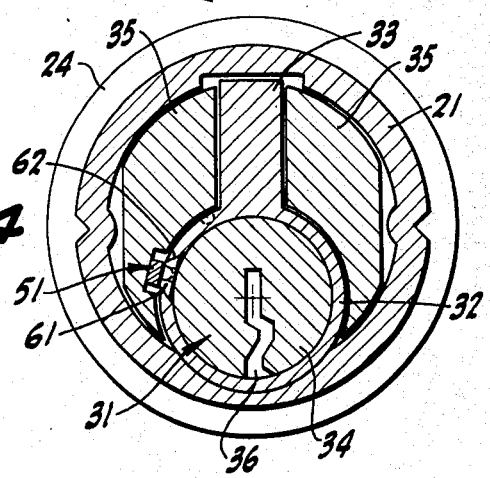
FIG. 4 is a cross-section of a structure of FIG. 3, the plane of section being indicated by the line 4—4 of FIG. 3.
Figure 3:
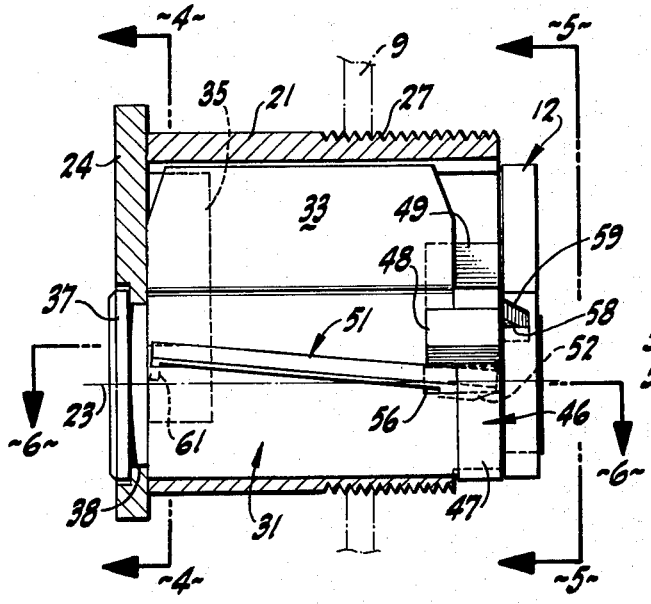
FIG. 3 is a cross-section through the cylinder mechanism of the structure shown in FIG. 1, the plane of cross-section being indicated by the line 3—3 of FIG. 2.
Figure 5:
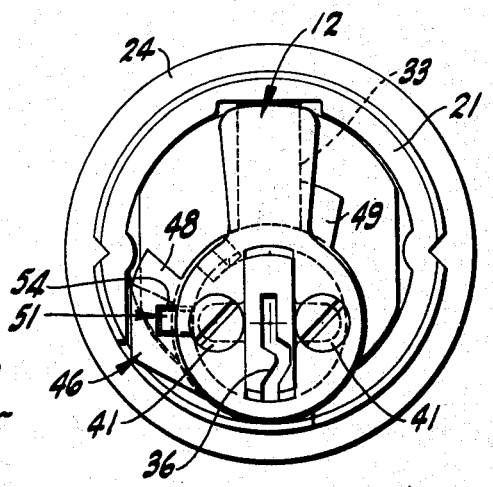
FIG. 5 is an end elevation of the structure of FIG. 3, the plane of the view being indicated by the line 5—5 of FIG. 3.
Figure 13:
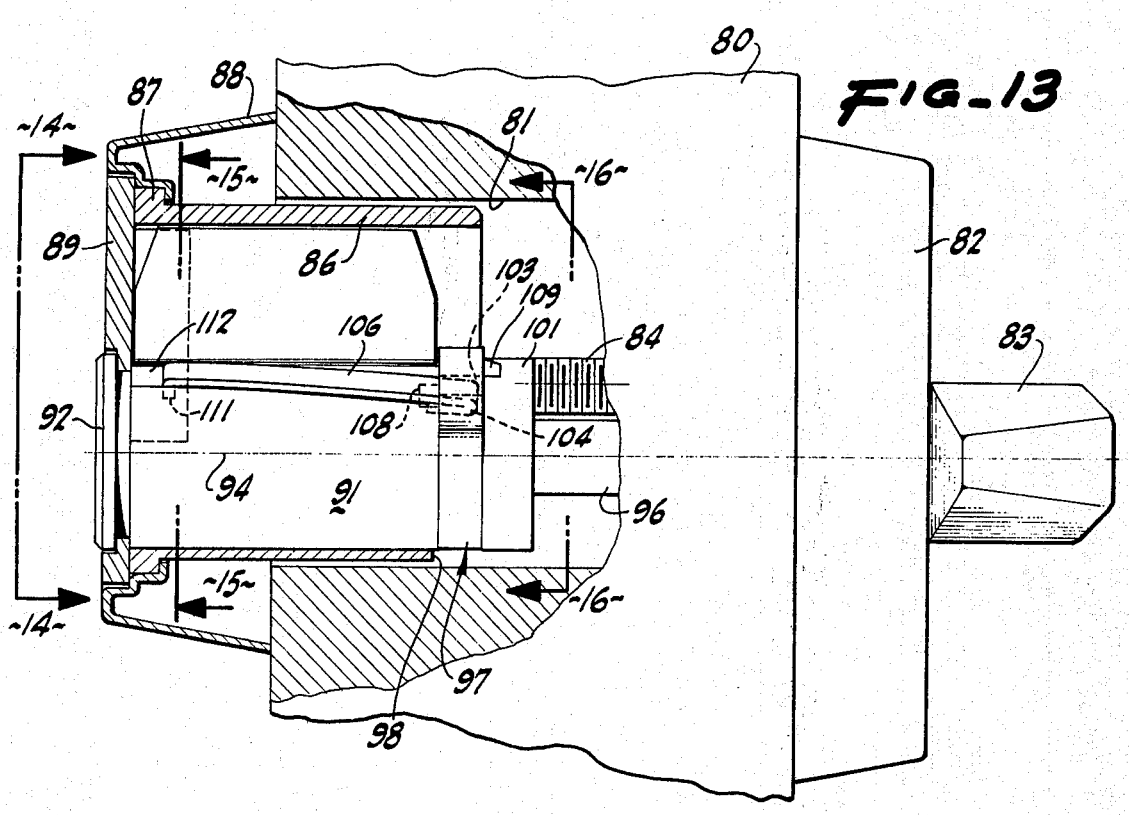
FIG. 13 is an end elevation of a door panel, somewhat like FIG. 1, but showing a different lock in cross-section on a generally vertical plane.
Figure 14:
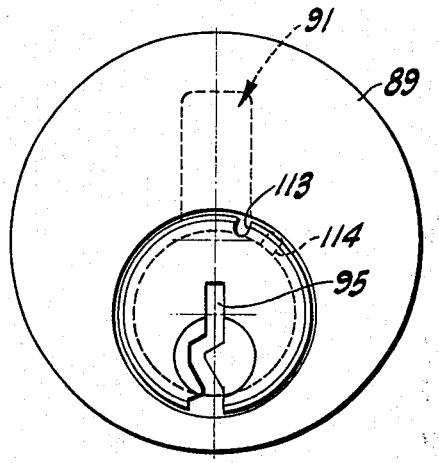
FIG. 14 is an end elevation of the structure of FIG. 13, the plane of the view being indicated by the line 14—14 of FIG. 13.
Figure 16:
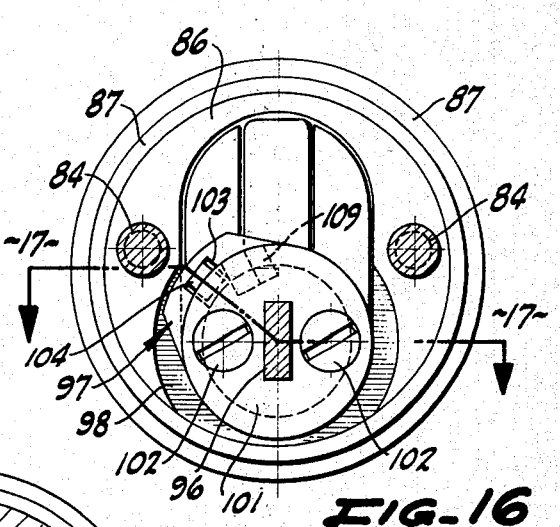
FIG. 16 is a cross-section, the plane of which is indicated by the line 16—16 of FIG. 13.
Figure 15:
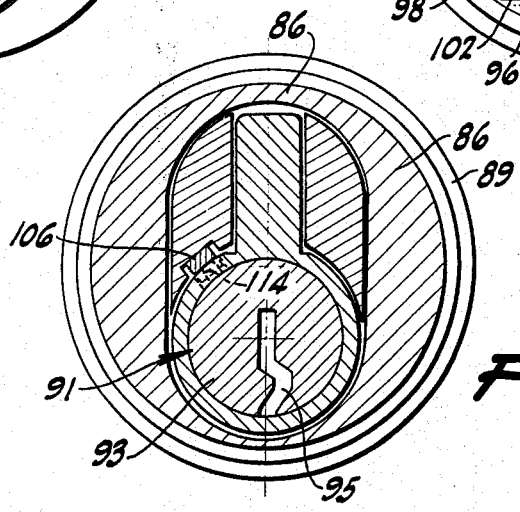
FIG. 15 is a cross-section, the plane of which is indicated by the line 15—15 of FIG. 13.

In the arrangement shown in FIG. 1, a door panel 6 of the customary swinging kind is provided with an interior knob actuator 7 and an exterior lever actuator 8 on a lock frame 9 arranged for controlling the operation of a latch bolt 10 in the usual way. There is also a deadbolt 11 which, through appropriate, standard mechanism, is impelled to and fro in accordance with the rotation of an actuating lever 12 (FIGS. 3, 5 and 8).

Also mounted in the door panel in connection with the remaining parts of the lock mechanism is a lock shell 21 designed to be installed in a bore 22 in the panel 6 and associated with the remaining lock structure. The shell 21 is a tubular member arranged with its elements generally parallel to an axis 23 offset from the tube center. Abutting the front end of the shell is a separate disc-like face plate 24 of larger diameter than the shell and seated either directly against the door panel or against a spacer ring 26. The shell 21 is held tightly in position by interengagement of external threads 27 on the shell with appropriate receiving threads in the lock frame 9 secured in the door panel.

Disposed within the shell in the customary fashion is a pin tumbler unit 31 incorporating several related parts and characterized by a generally circular-cylindrical body 32 that is symmetrical with the axis 23 and having an integral wing 33 or flag extending radially. The wing lies between abutments 35 projecting inwardly from the face plate 24. The body wing receives springs and pin tumblers (not shown) in the customary way and in cooperation with a key plug 34. This is rotatable within the pin tumbler body 32 about the axis 23 and is contoured to provide a keyway 36 extending generally through the key plug. The keyway is available on the outside of the lock unit through a key disc 37 that is rotatable against the face plate 24, preferably against a deeper flange 38 thereon. When the parts are appropriately assembled, the pin tumbler unit body 32 is seated against the inside of the face plate 24 and the key disc 37 seats against the outside of the face plate but with clearance to leave the key plug 34 rotatable about the axis 23 within the pin tumbler unit. The plug 34 is the receiver for an appropriate actuating key 39.

At the far or inner end of the pin tumbler unit the key plug 34 receives the dead bolt actuating lever 12. This is considered as part of the pin tumbler unit but is made as a separate element secured in position for rotation with and against endwise displacement with respect to the plug 34 by a pair of fastenings 41. The lever actuating 12 is properly located for interengagement with the bolt 11 through appropriate, standard means, not shown.

As so far described, the lock mechanism is substantially standard and is available to operate the dead bolt 11 by rotation of the key 39 in opposite directions and in the ordinary way. That is, upon rotation of the key 39 in the keyway, the key plug 34 is conjointly rotated about the axis 23 and causes rotation of the actuating lever 12 so that the lever swing projects or retracts the bolt 11.

Particularly pursuant to the invention, additional mechanism is provided so that the pin tumbler unit 31, including the face plate 24 and other contained and attached parts, may be readily removed from the lock shell 21 and related mechanism under appropriate circumstances. For that reason a stop lever 46 is rotatably mounted on the key plug adjacent the inner end thereof. The stop lever includes a ring portion 47 surrounding the outside of the key plug and likewise includes a couple of stop lugs 48 and 49 for restricting the relative rotation of the stop lever on the key plug about the axis 23 by contact with the wing on the body 32.

Also as part of the removal mechanism, there is provided a rod 51 disposed between the outside of the pin tumbler unit body 32 and the inside of the shell 21 and extending longitudinally. The rod 51 may take the form of a somewhat flattened plate, near one end having a radially extending clutch lug 52. The rod is movable in a generally axial direction and also has some bodily rotary movement about the axis 23. The clutch lug 52 and adjacent portions of the integral rod 51 are designed to reciprocate with loose guidance in a through channel 54 in the stop lever 46. The clutch lug is somewhat longer axially than the thickness of the stop lever. Formed in and entering into the end of the pin tumbler unit body 32 is a slot 56 adapted to receive the radially inwardly projecting portion of the clutch lug. The rod and clutch lug, therefore, can occupy a position with the clutch lug in both the stop lever 46 and in the end of the pin tumbler unit body so that no relative rotation of those parts about the axis 23 can occur.

In addition, the actuating lever 12 is formed with a slot 58 extending in an axial direction at least into the front face thereof and in a position to be sometimes aligned with the end of the clutch lug 52. In appropriate positions of the parts, the lug 52 can be displaced axially to occupy the stop lever 46 in part and to occupy the actuating lever 12 in part. Under those conditions the stop lever and the actuating lever are locked to rotate together, within limits.

It is also arranged that the slot 58 on the side has an inclined cam face 59 effective to bear against the corner of the rod 51 or clutch lug. Upon appropriate relative movement between the actuating lever and the rod, the clutch lug and the rod are displaced axially toward the left as seen in FIGS. 10 and 3, for example.

While the rod and clutch lug can be actuated in any convenient fashion and from any convenient point, it is preferable to provide an actuating means accessible from the outside or exterior face of the lock unit. For that reason the rod 51 is extended to a point near the forward or outer end of the pin tumbler unit 31. To retain the rod movably in position, it is provided at such end with a hook 61 axially movable and slightly rotatable in a dovetail notch 62 formed in the body 32 of the pin tumbler unit.

More particularly in accordance of the invention, access from the outside to the end of the rod 51 is afforded by a tool access passage generally designated 63 (FIG. 9). This has one arcuate portion 64 cut through the inner flange 38 of the face plate 24 in a particular polar location. The tool access passage is also inclusive of an arcuate portion 66 cut through the rim of the key disc 37 in a particular polar location. Normally the two portions 64 and 66 of the tool access passage are out of registry. No ready access is had from the outside toward the inside of the lock mechanism. But when an appropriate key 39 is put into the keyway and the key plug 34 is rotated, the two access passage portions 64 and 66 are aligned with each other. Furthermore, they then both axially align with the hook 61 at the end of the rod 51.

Under those circumstances a tool 67 (FIG. 9), such as a stiff wire, can be introduced through the aligned tool access passage 63 and can engage the end of the rod 51. By pressure, the tool can displace the rod toward the right, as shown in FIGS. 9 and 10. As the rod is displaced, the clutch lug 52 is moved out of occupancy of the slot in the pin tumbler unit 31 but remains in occupancy of the slot 54 in the stop lever 46. The displacement of the rod is enough to move the clutch lug 52 also into occupancy of the notch 58 in the key plug end plate and actuating lever 12. Under the displaced conditions, and as the proper key 39 is rotated, the stop lever 46 is free to turn and is readily moved together with the key plug from a blocking position in axial alignment with a portion of the shell 21, as shown in FIG. 8, into an unblocking or free position, as shown in FIG. 12, clear of the end of the shell. In the clear position there is nothing to preclude the axial removal, toward the left in FIG. 3, of the entire removable, pin tumbler unit 31 including the face plate 24 and the actuating lever 12.

When a similar, substitute pin tumbler or cylinder mechanism is fully introduced into the lock shell 21 with the parts substantially in the clear position just described, the key 39 is then rotated from its normal position. That has the effect of rotating the actuating lever 12 in a counterclockwise direction as seen in FIG. 12, for example. Such rotation is accompanied by similar rotation of the stop lever 46 because the clutch lug 52 interengages the two parts. When the stop lever gets into its blocking position, as shown in FIGS. 5 and 8, it does not rotate any farther because the stop 49 is against the wing portion of the body 32. Further counterclockwise rotation (FIG. 5) of the actuating lever 12 causes the cam face 59 to bear against the corner or end of the rod and clutch lug 52 (FIG. 9) and displaces the rod 51 toward the left (FIG. 3) with the clutch lug 52 disengaged from the actuating lever 12 and displaced into the slot 56 in the pin tumbler unit body 32. The stop lever 46 is thus keyed to the stationary, pin tumbler unit 31 in its blocking position. This prevents axial withdrawal of the cylinder mechanism from the shell 21. The new cylinder is, therefore, completely installed for operation.

The motion of the rod 51 is a combination of axial displacement and rotation about the axis 23, the greater part of the rotation taking place at the inner end of the rod. The rod 51 is generally straight and the outside of the body 32 is circular-cylindrical, but there are sufficient clearances so that the motion of the rod follows closely against the surface of the body 32. The position is made particularly close in order to put a restriction on the otherwise free movement of the rod. Motion of the rod 51 is braked or resisted by providing the rod, as shown particularly in FIG. 9, with an intermediate bowed portion 71. This produces a rather heavy frictional loading between the ends of the rod and the adjacent surfaces of the pin tumbler unit. The frictional braking helps the rod to stay in either of its positions despite some casual extraneous or miscellaneous dislodging forces. Particularly is the rod expected to stay in its inactive normal location close to the key disc 37. The frictional resistance can be overcome by sufficient force exerted on the end of the rod by a tool 67 or on the end of the rod by the cam face 59. In this way there has been provided one arrangement in which a removable cylinder is afforded in a mortise-style lock installation.

As another version of the same general inventive concept there is provided, as shown in FIGS. 13–21 inclusive, a structure designed to be mounted in a door panel 80 having a bore 81 therein. There is an escutcheon 82 on the interior face of the panel 80 in which a thumb turn 83 is rotatably mounted. The escutcheon 82 is connected by screws 84 to a shell 86 having an outer flange 87. An outer escutcheon 88 engages the flange 87 and abuts against the outer face of the panel 80. The thumb turn 83 is connected to the lock bolt mechanism in the standard way (not shown).

Seated against the shell 86 and within the escutcheon 88 is a face plate 89. This is a separate plate held against a pin tumbler unit 91 by the key disc 92 of a key plug 93 rotatable about an axis 94. The key plug has the customary keyway 95 therein and the customary internal tumbler pins and springs (not shown) to provide motion to a driver bar 96, all according to standard practice. That is, an appropriate key in the keyway 95 is effective to rotate the key plug 93 and the driver bar 96 to work the lock.

In accordance with the present arrangement a stop lever 97 is provided near the inner end of the pin tumbler unit 91 and is freely rotatable around the plug 93 about the axis 94. The stop lever is adapted in one position to lie behind an inner end face 98 of the shell 86 (FIG. 19), and in another rotated position to lie within the interior bore of the shell (FIG. 21). In this lever position, the pin tumbler unit is axially movable through the shell 86. The stop lever is partly positioned axially by an actuator disc 101 secured on the end of the key plug 93 by fastenings 102. The actuator disc 101 rotates in unison with and is in effect part of the key plug and is appropriately connected to the driver bar 96.

In this instance also, the stop lever 97 has a through channel 103 in which is reciprocable a clutch lug 104 near the inner end of a rod 106. The clutch lug in one position is retracted into a notch 108 in the end of the outer body of the pin tumbler unit 91, whereas in another extreme position the clutch lug is projected into a cam notch 109 in the actuator drive disc 101, in effect part of the key plug 93. The clutch lug 104 is long enough so that it is always in engagement with the stop lever and is alternatively also in engagement with the pin tumbler unit 91 or with the actuator disc 101. The rod 106 is bowed or sprung slightly to afford a frictional load and at its forward end is provided with a hook 111 operating in a notch 112 in the pin tumbler unit. The notch 112 is positioned to be in axial alignment with a tool access passage made up of a notch 113 in the disc 92 and a notch 114 (FIG. 20) in the internal flange of the face plate 89.

The operation of this structure is very much like the operation of the mortise mechanism. When a proper key is inserted into the keyway 95 and the key plug is rotated to align the notches 113 and 114 (FIG. 20) to provide a tool access passage, then a tool such as a wire can be inserted endwise or axially through the tool passageway and can be pressed against the hook end 111 of the rod 106. Sufficient pressure overcomes the friction and moves the rod from a left-hand, extreme position. In the left-hand position the lug 104 is in the notch 108 and so locks the stop lever 97 in blocking position behind the end face 98 of the shell 86. The rod is pressed into a new, right-hand position in which the clutch lug 104 is displaced to the right (FIG. 20) and into cam notch 109 in the key plug actuator disc 101 on the key plug 93. Then when the key plug is rotated by a key in the keyway 95, the actuator disc 101 and the stop lever 97 are rotated in unison until the stop lever is away from the end of the shell 86. The pin tumbler unit 91, including the face plate 89, the actuator disc 101 and even the driver bar 96, can be withdrawn forwardly and largely through the shell 86.

When the pin tumbler unit or cylinder or key mechanism is reintroduced or a new one is inserted, the key is finally rotated in the opposite direction. The cam notch 109, in rotating with the disc 101, displaces the rod 106 to the left, as seen in FIG. 22. This restores the clutch lug 104 from its position occupying the notch 109 into a position occupying the notch 108 while still occupying the channel 103 in the stop lever 97. This rotation of the plug and stop lever leaves the stop lever in line with the end of the shell 86. The rod 106 has been restored to its initial position with the hook 111 close to the outer face of the disc 92.

In this way the cylinder unit is withdrawn easily from its lock mounting simply by the use of a proper key and a simple tool such as a wire and is as easily restored to operation. With either of these arrangements the tool need not remain in the plug. In fact, the tool must be withdrawn from the key plug after the rod 106 has been displaced in order that the key and key plug can be rotated to carry out the releasing or engaging functions of the stop lever 97. Thus, the release mechanism is pre-conditioned by the brief introduction of a wire, then the wire is withdrawn and the removal operation then continues. The frictional load on the rod is such that it remains in displaced position until restored by the cam 109 as previously described.

What is claimed is:

1. A removable cylinder for a lock having a shell extending along an axis, a pin tumbler unit movable along said axis into and out of said shell, means for stopping movement of said pin tumbler unit into shell, a key plug mounted in said pin tumbler unit for rotation relative thereto about said axis, a stop lever rotatable about said axis between a first position in axial alignment with a part of said shell and a second position clear of said part of said shell, a rod disposed between said shell and said pin tumbler unit, and a clutch lug on said rod and movable with said rod in an arc about said axis and in a direction parallel to said axis between a first position in engagement with both said pin tumbler unit and said stop lever and a second position in engagement with both said stop lever and said key plug.

2. A device as in claim 1 in which said stopping means is a face plate on said pin tumbler unit adapted to abut said shell at one end thereof.

3. A device as in claim 2 in which said key plug includes a key disc rotatable about said axis relative to said shell and at the end of said key plug adjacent said face plate.

4. A device as in claim 3 including means at least in said face plate defining a tool access passage from one side of said face plate to the other side thereof.

5. A device as in claim 4 in which said passage defining means is also in said key disc.

6. A device as in claim 5 in which said passage defining means in said face plate is in axial alignment with said rod.

7. A device as in claim 5 in which said passage defining means in said key disc is in at least one position of rotation of said key disc about said axis in axial alignment with said passage defining means in said face plate and in alignment with said rod.

8. A device as in claim 1 in which said rod is disposed to extend in an axial direction along said pin tumbler unti.

9. A device as in claim 8 in which said rod is supported in said stop lever and said pin tumbler unit.

10. A device as in claim 8 including means for resisting approximately axial movement of said rod relative to said pin tumbler unit.

11. A device as in claim 10 in which said resisting means is a frictional interference fit between said rod and said pin tumbler unit.

12. A device as in claim 1 including a hook at one end of said rod and means forming a notch in said pin tumbler unit for receiving said hook.

13. A device as in claim 1 in which said pin tumbler unit has a slot therein to receive said clutch lug.

14. A device as in claim 1 in which said stop lever has a slot therethrough to receive said clutch lug and said rod.

15. A device as in claim 1 in which said key plug has a slot therein to receive said clutch lug and said rod.

16. A device as in claim 15 in whcih said slot in said key plug has a cam face adapted to engage an end portion of said clutch lug and said rod.

17. A device as in claim 1 including means for limiting the extent of rotation of said stop lever about said axis.

18. A device as in claim 1 in which said stop lever has a predetermined axial extent and said clutch lug has a greater axial extent.

* * * * *